US010081768B2

(12) United States Patent
Xin et al.

(10) Patent No.: US 10,081,768 B2
(45) Date of Patent: Sep. 25, 2018

(54) SULFUR REMOVAL FROM PETROLEUM FLUIDS

(71) Applicant: Cabot Corporation, Boston, MA (US)

(72) Inventors: Mei Xin, North Billerica, MA (US); Terry L. Collett, Naples, FL (US); Aatif A. Misbah, Cambridge, MA (US)

(73) Assignee: Cabot Corporation, Boston, MA (US)

( * ) Notice: Subject to any disclaimer, the term of this patent is extended or adjusted under 35 U.S.C. 154(b) by 0 days.

(21) Appl. No.: 15/565,794

(22) PCT Filed: Apr. 15, 2016

(86) PCT No.: PCT/US2016/027934

§ 371 (c)(1),
(2) Date: Oct. 11, 2017

(87) PCT Pub. No.: WO2016/168731

PCT Pub. Date: Oct. 20, 2016

(65) Prior Publication Data

US 2018/0119028 A1 May 3, 2018

Related U.S. Application Data

(60) Provisional application No. 62/149,166, filed on Apr. 17, 2015.

(51) Int. Cl.
*C10G 25/00* (2006.01)
*C10G 75/00* (2006.01)

(52) U.S. Cl.
CPC ..... *C10G 25/003* (2013.01); *C10G 75/00* (2013.01); *C10G 2300/1025* (2013.01); *C10G 2300/202* (2013.01)

(58) Field of Classification Search
CPC ..... C10G 25/003; C10G 2300/202
See application file for complete search history.

(56) References Cited

U.S. PATENT DOCUMENTS 3,542,669 A 11/1970 DeFeo
4,540,842 A * 9/1985 Allen ..... C07C 7/13 208/250
5,405,593 A * 4/1995 Knudson ..... B01D 53/02 423/244.03

FOREIGN PATENT DOCUMENTS

CN 1970696 A 5/2007
EP 0719584 A1 7/1996
JP 2011-093774 A 5/2011

OTHER PUBLICATIONS

S. Kumagai et al., Removal of Dibenzothiophenes in Kerosene by Adsorption on Rice Husk Activated Carbon, 88 FUEL 1975-1982 (2009).*
International Search Report and the Written Opinion of the International Searching Authority, or the Declaration for International Application No. PCT/US2016/027934, dated Jul. 15, 2016.

* cited by examiner

*Primary Examiner* — Randy Boyer

(57) ABSTRACT

A method for removing sulfur containing compounds from petroleum liquid. The method includes contacting the petroleum liquid with an activated carbon that has a high ash content, a high metal content and a significant amount of meso and macro porosity.

19 Claims, 4 Drawing Sheets

A
C
$H_2S$ Conc. (ppm)
200.00
150.00
100.00
50.00
0.00
ND
ND
Right after H2S purge - no carbon
No carbon, stirring for 10min and filtrated
0.5% Carbon
2.0% Carbon H2S 40ml/min, 15min
H2S 12ml/min, 10min
H2S Conc. (ppm)
400.0
300.0
200.0
100.0
0.0
ND
ND
NA
Right after H2S purge
No carbon, stirring for 10min and filtrated
Carbon A 2.0%
Carbon B 2.0%
Carbon C 2.0%

FIG. 4
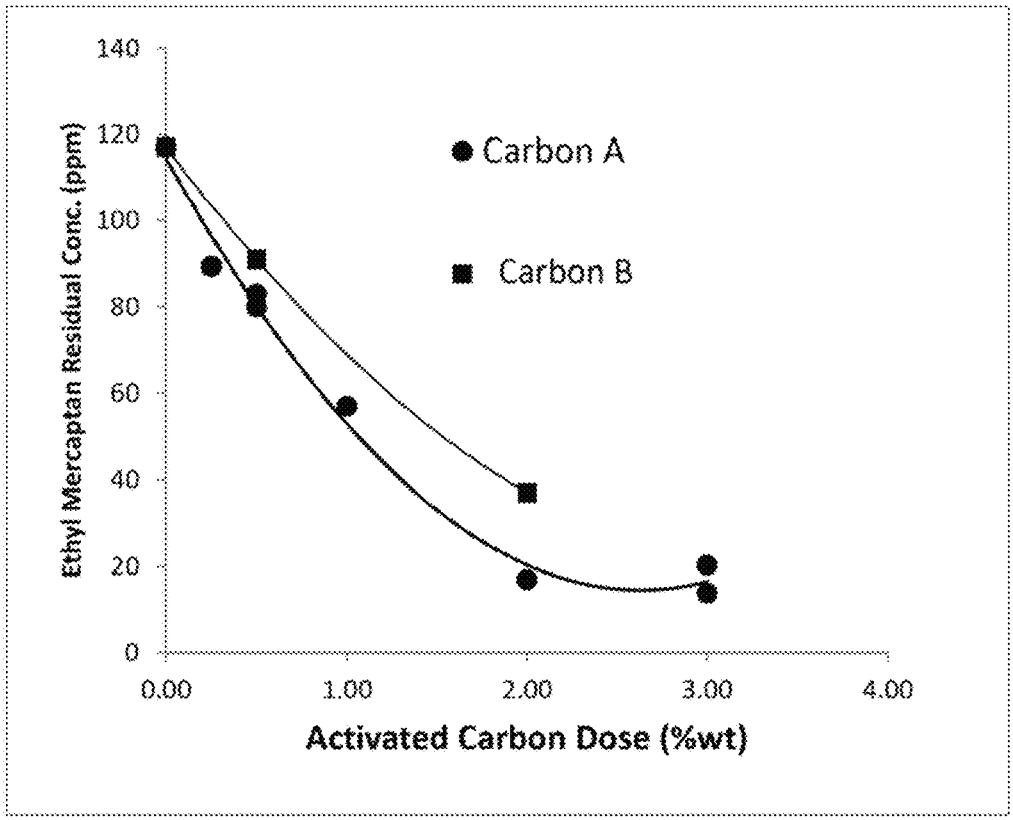
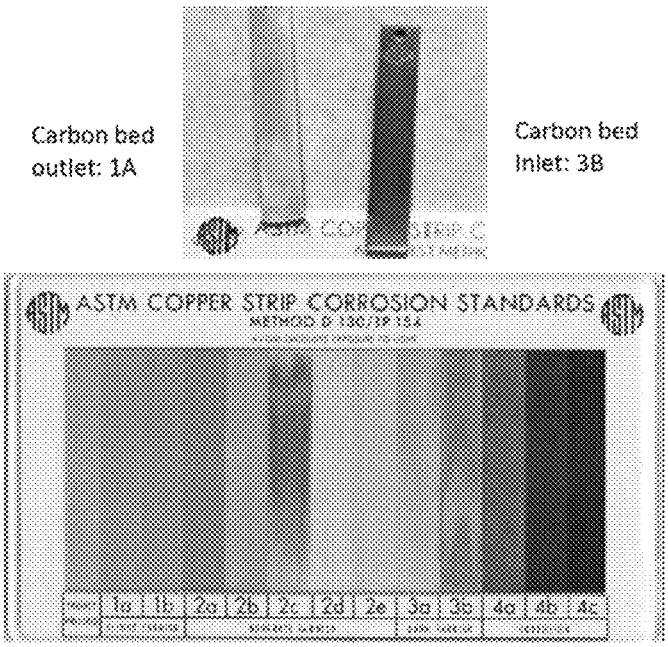
FIG. 5

SULFUR REMOVAL FROM PETROLEUM FLUIDS

CROSS REFERENCE TO RELATED APPLICATIONS

This application is § 371 national phase application of and claims the benefit of PCT/US2016/027934, filed on Apr. 15, 2016, which claims the benefit of U.S. Provisional Patent Application No. 62/149,166, filed on Apr. 17, 2015. Both applications are incorporated by reference in their entirety.

FIELD OF THE DISCLOSURE

The present disclosure relates to the removal of sulfur compounds from hydrocarbons and, in particular, the use of activated carbon to remove sulfur compounds from petroleum derived liquids.

BACKGROUND

The production and transmission of natural gas results in the formation of natural gas condensates that can be valuable as fuels or as feedstocks. Natural gas liquids (NGL) often include sulfur containing compounds such as hydrogen sulfide, thiols and mercaptans. Removal of these compounds is helpful in increasing the value of the NGL and in controlling odor, toxicity and corrosion. Similarly, gasoline and other petroleum fuels may contain sulfur compounds that are undesirable for performance, environmental or regulatory reasons.

SUMMARY

In one aspect, a method of removing sulfur compounds from a petroleum derived liquid is provided, the method comprising contacting a petroleum liquid with activated carbon, the petroleum liquid comprising at least one sulfur containing compound, the activated carbon having an ash content of greater than 20% or greater than 25% by weight and a metal content of greater than 2,000 ppm by weight, and removing greater than 90% of the sulfur compounds originally in the petroleum liquid to provide a reduced sulfur petroleum liquid. The petroleum liquid can initially contain greater than 1% sulfur by weight, and the total sulfur, hydrogen sulfide or mercaptan content can be reduced to less than 10 ppm. The petroleum liquid can be flowed through one or more beds of the activated carbon, and the flow rate through the bed(s) can be less than or equal to 1.5 ft/min.

In another aspect a method is provided, the method comprising determining the concentration of sulfur or a sulfur containing compound in a petroleum liquid stream, identifying the stream as requiring removal of sulfur or a sulfur containing compound, contacting the petroleum liquid with an activated carbon, the activated carbon having an ash content of greater than 20% and a metal content of greater than 2,000 ppm, and reducing the sulfur content of the petroleum liquid to less than 10 ppm total sulfur or less than 10 ppm of the sulfur containing compound. The petroleum liquid can be flowed through one, two or more beds of the activated carbon, and can be re-flowed through the same bed more than once. The sulfur concentration can be reduced by more than 90%, the hydrogen sulfide content to below 5 ppm or 1 ppm, and the petroleum liquid filtrate can be sold, transported or burned as a non-sulfur gas condensate. The treated condensate can be analyzed for reduced sulfur content using an optical technique such as colorimetry, turbidimetry or transmission/absorbance. Color bodies can be removed concurrently from the petroleum liquid with the same activated carbon. The activated carbon may comprise native metals that are uniformly distributed throughout the activated carbon, may contain less than 5,000 ppm halogens by weight, and may contain greater than 2,000 ppm iron, greater than 1,000 ppm aluminum, greater than 1,000 ppm titanium and/or greater than 1,000 ppm tungsten. The initial concentration of total sulfur, hydrogen sulfide, mercaptans or thiols may be greater than 10×, greater than 100× or greater than 1000× the final concentration of the substance.

In another aspect, a method of reducing the corrosivity of a natural gas liquid is provided, the method comprising providing a natural gas liquid exhibiting an ASTM-1838 Copper Strip Corrosion Test rating of higher than 2e; contacting the natural gas liquid with an activated carbon to reduce the ASTM-1838 rating to 1b or lower and the total sulfur concentration to less than 150 μg/g. The activated carbon can have a total ash content of greater than 20%, greater than 25% or greater than 30%.

In another aspect, a purification system is provided, the purification system including a tank including an inlet and an outlet, a layer of activated carbon supported in the tank, the activated carbon having a total ash content of greater than 20% by weight, a natural gas liquid at the inlet having a total sulfur concentration of greater than 1000 μg/g, and a natural gas liquid at the outlet having a total sulfur concentration of less than 150 μg/g.

BRIEF DESCRIPTION OF THE DRAWINGS

FIG. 4 is a graph of one embodiment showing the amount of ethyl mercaptan removed by an activated carbon and an acid washed activated carbon;

FIG. 5 is a photograph of the results of a copper strip corrosion test and an ASTM comparison chart for performing the test.

DETAILED DESCRIPTION

Figure 1:
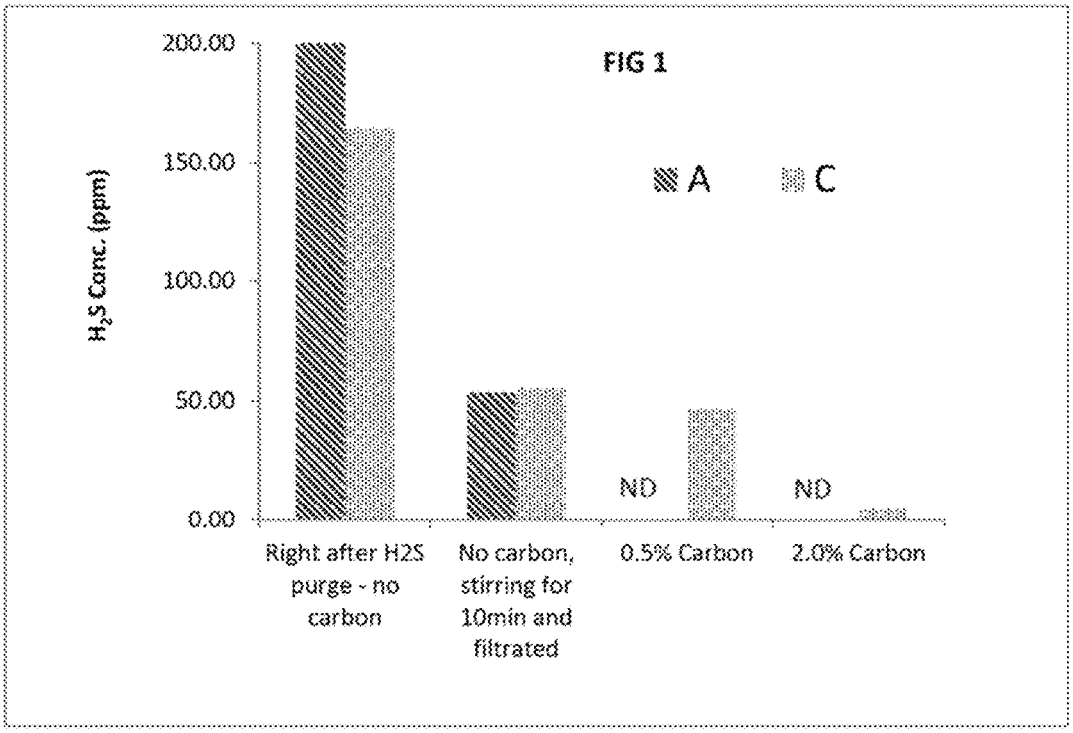
FIG. 1 is a bar graph showing the sulfur removal efficiency of various embodiments.

In one aspect, sulfur containing compounds such as elemental sulfur, hydrogen sulfide ($H_2S$), carbon disulfide ($CS_2$), carbonyl sulfide (COS) and mercaptans are efficiently removed from aliphatic hydrocarbons including petroleum fuels, naphtha, light liquid hydrocarbons (99% by weight below $C_{12}$), and natural gas liquids (NGL). NGL includes natural gas condensate (NGC) as well as other hydrocarbon based liquids that are recovered from the processing and transmission of natural gas or oil. NGC consists primarily of hexane and heptane mixed with some lighter weight hydrocarbons. Other treatable materials include petroleum hydrocarbons such as gasoline and mixtures of light hydrocarbons from $C_2$ to $C_3$ to $C_4$ to $C_5$ to $C_6$ to $C_7$ to $C_8$ to $C_9$ to $C_{10}$ to $C_{11}$. Liquified petroleum gas (LPG) is typically either propane or butane or a mixture thereof and may be purified using the techniques described herein. The activated carbon used to remove sulfur can be a lignite carbon and may have an ash content of greater than 15%, greater than 20%, or greater than 25% by weight and may include a transition metal content of greater than 1,000 ppm by weight. The activated carbon may also have a high degree of meso and macroporosity. Petroleum liquids can be contacted with activated carbon in any number of ways, including mixing activated carbon particles with the petroleum liquid or passing the petroleum liquid through a bed containing activated carbon.

Although the examples herein are directed to light, mostly aliphatic hydrocarbons, certain embodiments may be equally useful with other hydrocarbons such as crude oil, solvents and fuels such as diesel, #2, #4 and #6 heating oils, jet fuel and gasoline. The removal techniques described herein are capable of working with higher viscosity hydrocarbons and can be effective with hydrocarbon based fluids having a viscosity of greater than 50, greater than 100, greater than 200 or greater than 500 centipoise. Although the materials and processes described herein are applicable to a wide variety of petroleum based fluids, many of the descriptions below will use NGL as an example material.

The composition of different petroleum liquids and other petroleum hydrocarbons can vary, and specific gravities can range from about 0.5 to about 0.8 g/mL. For instance, NGL is typically composed of $C_2$ to $C_{12}$ straight chain and branched alkanes. Specific compounds in NGLs often include ethane, propane, butane, iso-butane, pentane, iso-pentane, hexane and additional hydrocarbons having greater than 6 carbons. Smaller amounts of aromatic hydrocarbons (BTEX), cyclohexane and naphthenes may also be present. The hydrocarbon composition of a typical NGL is provided below in Table 1. In addition to its odor and toxicity, NGLs such as NGC can exhibit a straw like color that should be removed to maximize the value of the hydrocarbons.

TABLE 1

Composition of typical natural gas condensate

| Compound | Molar percent | Weight percent |
|---|---|---|
| Methane | 1.0 | 0.3 |
| Ethane | 7.3 | 3.4 |
| Propane | 20.0 | 13.4 |
| Iso-butane | 5.3 | 4.7 |
| n-butane | 18.2 | 16.1 |
| Iso-pentane | 8.2 | 9.0 |
| n-pentane | 10.9 | 12.0 |
| ≥6 carbon alkanes | 28.9 | 41.0 |

Petroleum liquids can include a variety of sulfur containing compounds that can be odorous, corrosive, toxic or environmentally harmful. These sulfur containing compounds can include hydrogen sulfide, thiols and mercaptans. A list of sulfur containing compounds at typical concentrations found in NGL is provided in Table 2. Methods to reduce the amount of these compounds in the NGL can include removal, sequestration and destruction. The methods described herein can include adsorption, destruction or a combination of both. Destruction can be through oxidation in which activated carbon can serve as an oxidation catalyst. In some embodiments, greater than 50%, greater than 75%, greater than 90%, greater than 95% or greater than 99% of mercaptans, hydrogen sulfide, elemental sulfur, carbon disulfide, carbonyl sulfide, thiols or total sulfur compounds can be removed. Prior to treatment, the NGL may contain greater than 100 ppm, greater than 1,000 ppm, greater than 5,000 ppm, greater than 1%, greater than 2% or greater than 5% total sulfur, hydrogen sulfide, elemental sulfur or mercaptans, by weight.

In some embodiments, the concentration of sulfur containing compounds (measured as total elemental sulfur by weight unless otherwise specified) in an NGL can be reduced to less than 1.0%, to less than 0.5%, less than 0.1%, less than 500 ppm, less than 100 ppm or less than 10 ppm. In some embodiments, the concentration of hydrogen sulfide, by weight, in an NGL can be reduced to less than 1.0%, less than 0.5%, less than 0.1%, less than 500 ppm, less than 100 ppm, less than 10 ppm, less than 5 ppm or less than 2 ppm. In some embodiments, the concentration, by weight, of mercaptans, elemental sulfur, carbonyl sulfide, carbon disulfide and hydrogen sulfide, individually or in aggregate, in an NGL can be reduced to less than 1.0%, to less than 0.5%, less than 0.1%, less than 500 ppm, less than 100 ppm, less than 10 ppm, less than 5 ppm or less than 2 ppm. Levels of mercaptan and hydrogen sulfide can be reduced to levels where their odor is non-detectable to humans. Those in the field can choose to remove sulfur containing compounds from NGL with activated carbon when they have identified an NGL sample having a sulfur concentration or a sulfur compound concentration above a pre-specified limit. Sulfur compounds can be removed concurrently with the removal of color bodies using activated carbon. After removal, the NGL sample can be analyzed for total sulfur content or for the remaining concentration of specific compounds, such as hydrogen sulfide or mercaptan.

TABLE 2

Sulfur containing compounds found in Natural Gas Liquids
LIGHT END COMPONENTS RESULTS, PPM/VOL

| | |
|---|---|
| CARBONYL SULFIDE (COS), PPM | 0.989 PPM |
| HYDROGEN SULFIDE ($H_2S$), PPM | 2.147 PPM |
| CARBON DISULFIDE ($CS_2$), PPM | 2.836 PPM |
| DIMETHYL SULFIDE $(CH_3)_2S$, PPM | 0.159 PPM |
| DIMETHYL DISULFIDE $(CH_3)_2S_2$, PPM | LESS THAN 0.001 PPM |
| SULFUR DIOXIDE ($SO_2$), PPM | LESS THAN 0.001 PPM |
| METHYL SULFIDE $(CH_3)S$, PPM | LESS THAN 0.001 PPM |
| TOTAL LIGHT END SULFURS, PPM | 6.131 PPM |
| MERCAPTAN COMPONENTS | |
| METHYL MERCAPTAN, PPM | 1.970 PPM |
| ETHYL MERCAPTAN, PPM | 2.461 PPM |
| iso-PROPYL MERCAPTAN, PPM | 1.178 PPM |
| tert-BUTYL MERCAPTAN, PPM | 0.315 PPM |
| sec-BUTYL MERCAPTAN, PPM | 1.024 PPM |
| PENTYL AND HEAVIER MERCAPTANS, PPM | 2.625 PPM |
| 2-METHYLTHIOPHENE, PPM | 0.041 PPM |
| 3-METHYLTHIOPHENE, PPM | 0.103 PPM |
| THIOPHENE, PPM | 0.822 PPM |
| BENZOTHIOPHENES, PPM | LESS THAN 0.001 PPM |
| TOTAL ALL OTHER THIOPHENES, PPM | 0.153 PPM |
| TOTAL MERCAPTANS AND THIOPHENES, PPM | 10.692 PPM |
| TOTAL ALL | 16.823 PPM |

In some embodiments, the activated carbon is a lignite carbon. As used herein, a lignite carbon comprises greater than 25% total ash, by weight, has a pore volume of 0.8 to 1.1 mL/g by nitrogen and mercury isotherm test (Micromeritics) and an average pore size (diameter) of greater than 10 nm. Various embodiments can include micropores (diameter of less than 2 nm) mesopores (pore diameters of 2 to 50 nm) and macropores (pore diameters of greater than 50 nm). Some activated carbons described herein may have a greater percentage of pore volume attributed to mesopores than micropores. The same or other embodiments may have a greater percentage of pore volume attributed to macropores than micropores and/or may have a greater percentage of pore volume attributed to macropores than mesopores. In some cases, activated carbons may have greater than 50, 60 or 70% of pore volume attributed to macro and mesopores. In some embodiments, the iodine number of the activated carbon is less than 1055, less than 1000, less than 750, less than 700 or less than 675 when tested using ASTM D4607. When in powdered form, the activated carbon can have an average particle size of greater than 1, greater than 5, greater than 10 or greater than 20 μm. In some embodiments the average particle size may be less than 100, less than 50 or less than 25 μm. Particle size is measured by laser scattering in water.

Various activated carbons may include different amounts of total ash and acid soluble ash. For example, some embodiments of activated carbon may include total ash content (ASTM D2866) or acid soluble ash content (ASTM D6385) of greater than 5%, greater than 10%, greater than 15%, greater than 20%, greater than 25%, greater than 30% or greater than 35%. In the same or additional embodiments, activated carbon my contain less than 50%, less than 45%, less than 40%, less than 35%, less than 30% or less than 25% total ash or acid soluble ash.

In some embodiments, the activated carbon includes one or more transition metals. These metals may be in the form of salts or elemental metals. Specific embodiments may include one or more of, for example, iron, copper or molybdenum. Metals may be found in oxidation states of 0, $^{+}1$, $^{+}2$, $^{+}3$, $^{+}4$, $^{+}5$ or $^{+}6$, for example. Metals, for example, iron, copper, aluminum, titanium, magnesium, manganese, tungsten and molybdenum, or their oxides may be present, individually or in total at concentrations of greater than 100 ppm, greater than 1000 ppm, greater than 5,000 ppm, greater than 10,000 ppm or greater than 20,000 ppm, by weight. When used herein, the "concentration of a metal" is based on the percent by weight of metal atoms in the total mass of material. The "concentration of a metal oxide" is based on the percent by weight of the metal oxide molecule in the total mass. In some embodiments, a particular activated carbon may have a total metal concentration of greater than 10,000 ppm and an iron concentration of greater than 5,000 ppm by weight. The metals can be in the form of metal oxides and can be distributed evenly throughout the activated carbon, not only on the surface. This even distribution can differentiate activated carbons made from metal-containing lignite (native metals) from activated carbons for which metals are added after the formation of the activated carbon (doped metals). Activated carbon produced from lignite, such as PETRODARCO® MS activated carbon (Cabot Corp.), can include a variety of native metals at naturally high concentrations. For example, PETRODARCO MS activated carbon may have greater than 1,000 ppm (measured by XRF) of aluminum, iron, titanium and tungsten. Other metals such as magnesium, manganese, zinc, copper, nickel, chromium, vandadium, selenium, cobalt, molybdenum, lead, zirconium and arsenic may all be present at greater than 100 ppm by weight. Some or all of the metals may be in the form of oxides and some or all of the metals may remain after acid washing. The concentration of halogens, such as chlorine, fluorine, bromine and iodine (typically as halides), individually or as total halogens, may be below 20,000 ppm, below 10,000 ppm or below 5,000 ppm, by weight. This is in contrast to doped activated carbons which are typically treated with iodide salts and therefore contain high amounts of iodine.

Sulfur may be removed from a petroleum fluid using a single activated carbon or a mixture of two, three, four or more activated carbons. Two or more activated carbons in a mixture may have different metal content, different ash content, different pore sizes, different particle sizes, different surface treatments and/or may be produced from different source materials, such as coal, lignite, coconut husk, wood and peat. In some embodiments, metals or metal containing compounds are added to the activated carbon and in other embodiments the metals originate in the source material. In some embodiments, it has been found to be advantageous that the metals originate in the source material and are residual in the activated carbon after formation. For example, naturally occurring lignite can contain a transition metal such as iron that is retained in the activated carbon after production. Source material, such as lignite, may also contain native alkali metals or alkali earth metals that may contribute to the adsorption or oxidation of sulfur containing materials such as hydrogen sulfide. For example, an activated carbon, or its source material, may contain alkali metals and/or alkali earth metals such as potassium, sodium, magnesium or calcium at concentrations greater than 10 ppm, greater than 50 ppm, greater than 100 ppm or greater than 1,000 ppm. Alkali metals and alkali earth metals may oxidize sulfur containing materials such as hydrogen sulfide or mercaptans.

The concentration of sulfur and/or sulfur containing compounds in petroleum liquids can be reduced by contacting the petroleum liquid with activated carbon. The concentration of sulfur and/or sulfur containing compounds associated with an activated carbon can be increased by contacting the activated carbon with a petroleum liquid comprising sulfur containing compounds. Similarly, sulfur and sulfur containing compounds can be transferred from a petroleum liquid to an activated carbon. Sulfur containing compounds may be adsorbed in their native form or chemically altered and then adsorbed. For example, hydrogen sulfide can be oxidized with an iron inclusive activated carbon to produce ferric sulfate, which can then be efficiently adsorbed by the activated carbon. In other cases, in the presence of oxygen, iron can act as a catalyst and provide free radicals or active adsorption sites for the oxidation of sulfur containing compounds including hydrogen sulfide and mercaptans.

To remove sulfur from petroleum liquids using activated carbon, the petroleum liquid is contacted with the activated carbon for an amount of time adequate to remove the desired amount of sulfur compounds. This amount of time may be greater than, equal to, or less than the amount of time required to remove color from the petroleum liquid. The initial concentration of sulfur and/or sulfur containing compounds in the petroleum liquid sample can be determined by methods known to those of skill in the art. These methods include gas chromatography mass spectroscopy (GCMS), gas chromatography flame photoionization detector (GC-FPS), gas chromatography flame electron capture detector (GC-ECD), sulfur chemiluminescence chromatograph, X-ray fluorescence (e.g., ASTM D2622) and oxidative combustion and electrochemical detection (e.g., ASTM D6428). In some cases, the presence of, or concentration of, sulfur containing compounds can be estimated using smell. In other embodiments, the removal of color may also be an indicator of the removal of greater than 50%, greater than 75%, greater than 90%, greater than 95% or greater than 99% of the sulfur containing compounds, by weight. This may be true even when sulfur containing compounds do not contribute to color or absorbance. As a result, in some embodiments, a quick optical test (e.g., absorbance, colorimetric or turbimetric) can provide an indication as to whether or not a specific or desired amount of sulfur or sulfur containing compounds have been removed from the petroleum liquid. For instance, a decrease in light absorbance of 90% may indicate a sulfur removal of greater than 50% when using specific activated carbon or mixtures of activated carbon described herein.

Prior to sulfur removal, a user can determine if a specific petroleum liquid sample or stream has elevated levels of sulfur, hydrogen sulfide and/or mercaptans. For example, the user may know from analytical results, from odor, or from past experience that the sample contains elevated levels of the target materials. Knowing that the samples contain elevated levels, the user can then decide to remove sulfur from the petroleum liquid by contacting it with activated carbon. Knowing the exact or approximate concentration of sulfur containing materials in the petroleum liquid, the user can select operating parameters such as the amount of activated carbon, the number of parallel beds, the number of serial beds, the contact time and/or the flow rate of the petroleum liquid through the selected system. After treatment, the petroleum liquid sample can be analyzed, and the operator can record or certify that the concentration of sulfur or sulfur containing compounds is below a specified threshold. Alternatively, the actual concentration of sulfur or specific sulfur containing compounds can be recorded.

In one set of embodiments, powder or granular activated carbon can be mixed with a petroleum liquid for a length of time sufficient to remove a desired amount of sulfur containing compounds from the petroleum liquid. The petroleum liquid may be at ambient temperature, may be heated or may be chilled to below ambient temperature. It may be pressurized or at atmospheric pressure. The amount of activated carbon used should be adequate to remove a substantial amount (e.g., greater than 50%, greater than 75% or greater than 90%) of sulfur compounds within the desired time limit. The contact time can typically be less if a greater amount of activated carbon is used. Agitation may also help to increase the rate of removal. For instance, to achieve greater than 99% removal by weight with constant stirring, the activated carbon can be suspended in the petroleum liquid for greater than 10 minutes, greater than 30 minutes or greater than 1 hour. Activated carbon, including adsorbed sulfur compounds, can be removed from the petroleum liquid by using, for example, filtration, centrifugation, distillation or a combination thereof.

In another set of embodiments, petroleum liquids including sulfur containing compounds can be flowed through a bed or column of activated carbon. In some cases, the petroleum liquid can be circulated through the bed and flowed through the activated carbon multiple times, such as two, three, four or more times. Two or more beds can be arranged in series so that the petroleum liquid can optionally be flowed through a first bed, then a second bed, and any additional number of beds found necessary to reach a removal threshold concentration. Multiple beds in series may be preferred when the petroleum liquid contains high levels of sulfur containing compounds. The petroleum liquid stream can also be split into separate streams and flowed through two or more parallel beds. Additional parallel beds may prove useful in embodiments where the flow rate through the bed(s) should be reduced in order to increase the contact time between the activated carbon and the petroleum liquid. Some systems may include multiple beds in parallel and in series so that a matrix of activated carbon beds is provided. For example, matrices of activated carbon beds in series and parallel can be, for example 2×2, 2×4, 4×4, 4×6, 6×6, 1×4 and 4×1.

The activated carbon can be in the form of particles or granules and a specific mesh size can be chosen to minimize the pressure drop across the bed. Flow rates can be selected so that the petroleum liquid is contacted with the activated carbon for a period of greater than one minute, greater than 5 minutes, greater than 10 minutes, greater than 30 minutes or greater than 1 hour. Flow rates can vary depending on the geometry and capacity of the system, but it has been found that limiting superficial velocity to 1 ft/min and a contact time of at least 10 minutes can reduce the total sulfur concentration in the petroleum liquid by more than 50%, more than 75%, more than 90%, more than 95% or more than 99%, by weight. Liquids with lower levels of sulfur can be flowed at superficial velocities of greater than 1 ft/min, greater than 1.5 ft/min or greater than 2 ft/min. A filter, for example a 5 micron filter, can be used to prevent particulates from being carried with the liquid stream when it leaves the bed. Activated carbon beds can be replaced when the removal efficiency of the carbon drops below a threshold, e.g., 50%, of the removal efficiency of a fresh bed. The spent bed can be replaced with a new one, and in some cases the activated carbon can be washed or otherwise treated to remove the adsorbed compounds and allow for the re-use of the activated carbon. In other cases, the spent carbon is disposed of.

EXAMPLES

To test the efficacy of sulfur removal from NGL, a series of NGL samples spiked with hydrogen sulfide were made and treated using a novel activated carbon and a known activated carbon. To produce the spiked samples, $H_2S$ gas (5% in air) was bubbled into 60 grams of NGL at 25° C. at a rate of 40 mL/min for a period of 10 minutes. Analysis by GC-MS indicated that the sample contained 300 ppm of dissolved hydrogen sulfide. Additional samples were analyzed to show between 200 and 350 ppm after similar treatment. In the experiments described below, each starting sample was analyzed for $H_2S$ concentration prior to contacting the NGL with activated carbon.

Four different activated carbons were evaluated for sulfur and sulfur compound removal efficiency. Carbon A was PETRODARCO® MS activated carbon, available from Cabot Corporation. This activated carbon is made from lignite coal from Marshall, Tex. It has a total ash content of about 30%, contains 0.58% iron, 0.29% calcium, 0.04% magnesium, 0.06% potassium, 1.0 to 1.5% sulfur and 0.4% tungsten. Carbon A exhibits microporosity of about 0.2 $cm^3/g$, mesoporosity of about 0.35 $cm^3/g$ and macroporosity of about 0.45 $cm^3/g$. Carbon A has an iodine number of 651 mg/g. Carbon B was S-51™ activated carbon, available from Cabot Corporation. Carbon B is made from lignite coal from Marshall, Tex. Carbon B is acid washed and has a total ash content of about 19%, contains less than 0.025% iron and low or non-detectable levels of other metals. Carbon B exhibits microporosity of about 0.2 $cm^3/g$, mesoporosity of about 0.35 $cm^3/g$ and macroporosity of about 0.45 $cm^3/g$. Carbon B has an iodine number of 650 mg/g. Carbon C was NORIT® ROZ 3 activated carbon, available from Cabot Corporation. Carbon C is made from a wood and coconut husk mixture and is impregnated with 2% potassium iodide. Carbon C has a total ash content of about 11%, contains 0.15% iron, 0.60% calcium, 0.55% magnesium and 0.24% potassium. Carbon C exhibits microporosity of about 0.55 $cm^3/g$, mesoporosity of about 0.08 $cm^3/g$ and macroporosity of about 0.49 $cm^3/g$. Carbon C has an iodine number of 1055 mg/g. Carbon D was NORIT® GAC830 activated carbon, available from Cabot Corporation. Carbon D is a granular activated carbon having an effective size of 1.0 mm and is made by steam activation of bituminous coal and exhibits a high level of microporosity. Carbon D exhibits microporosity of about 0.39 $cm^3/g$, mesoporosity of about 0.13 $cm^3/g$ and macroporosity of about 0.27 $cm^3/g$. Carbon D has a total ash content of about 10 to 15%. Carbon D has an iodine number of 920 mg/g. Carbon E was NORIT® GCA48, available from Cabot Corporation. Carbon E is a coconut husk based carbon produced by steam activation. It has an iodine number 1100 mg/g, microporosity of about 0.45

$cm^3/g$, mesoporosity of about 0.10 $cm^3/g$ and macroporosity of about 0.15 $cm^3/g$. Its total ash content is less than 3%.

Example 1

A spiked NGC sample was prepared to 200 ppm hydrogen sulfide as provided above. Carbon A (0.25 g) was added to a 50 g aliquot of 200 ppm $H_2S$ NGC and the mixture was stirred for 10 minutes. A second test was run using 1.0 g of Carbon A with a 50 g aliquot of the 200 ppm $H_2S$ NGC. The activated carbon was filtered from the mixture and the filtrate was analyzed by GC-MS for hydrogen sulfide content. Two samples using Carbon C (0.25 g and 1.0 g) and a control (no activated carbon) were treated in the same manner. Results showing the residual hydrogen sulfide concentration in each sample are provided graphically in FIG. 1. As can be seen from the figure, Carbon A at 0.5% and at 2.0% by weight removed enough hydrogen sulfide so that the residual hydrogen sulfide in the filtrate was below the analytical detection limit (ND, <5 ppm). The control indicated that a significant amount of hydrogen sulfide was lost, it is believed, through filtering and stirring for 10 minutes, but at least 50 ppm still remained after the 10 minute agitation period. Carbon C removed some hydrogen sulfide but was only slightly better than the control at 0.5% and did not reduce the level to below the detection limit at a concentration of 2.0%. Results indicate that Carbon A is much more efficient at removing hydrogen sulfide from NGC than is Carbon C.

Example 2

Figure 2:
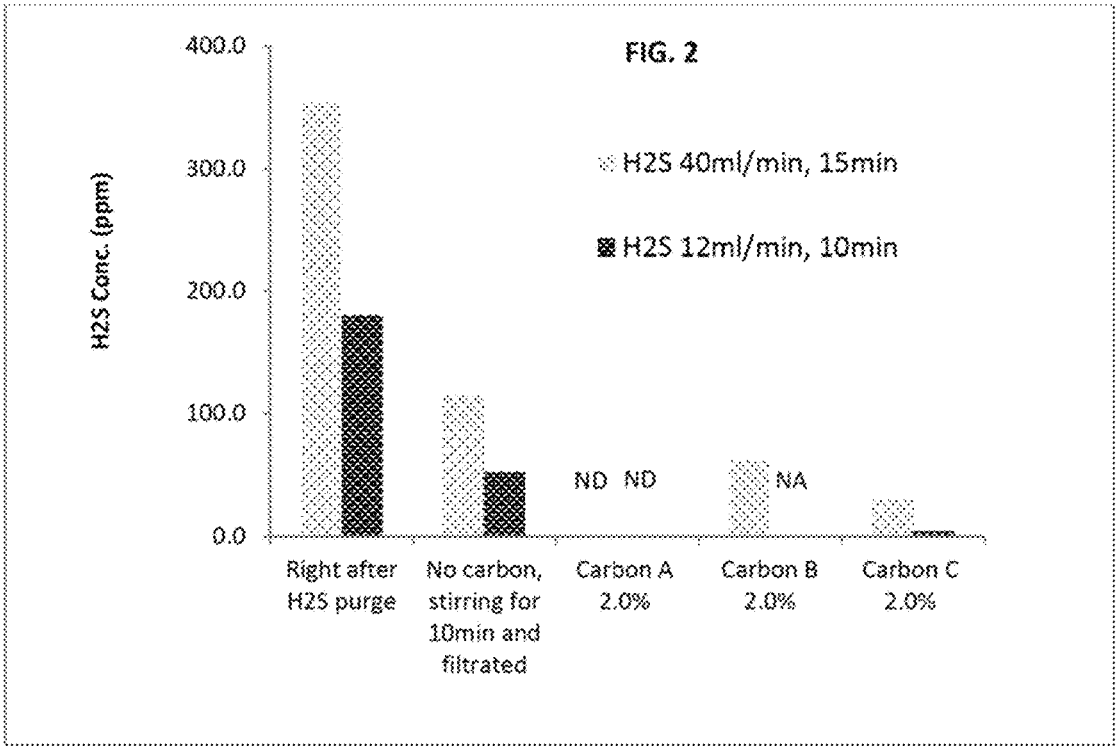
FIG. 2 is a bar graph showing the sulfur removal efficiency of additional embodiments.

In a second experiment, Carbons A, B and E, as well as a control, were tested at 2.0% (1 g in 50 g NGL) with two different NGC samples. The first NGC sample was spiked to 350 ppm hydrogen sulfide by bubbling 5% $H_2S$ through the NGC at 40 mL/min for 15 minutes. The second NGC sample was spiked to 180 ppm hydrogen sulfide by bubbling 5% $H_2S$ through the NGC at 12 mL/min for 10 minutes. The procedure for each activated carbon sample, and the control, was the same as in Experiment 1. As can be seen in FIG. 2, Carbon A was able to remove all (ND, <5 ppm) of the hydrogen sulfide from the 350 ppm hydrogen sulfide sample as well as from the 180 ppm hydrogen sulfide sample. Sample B was only tested on the 350 ppm sample and was able to reduce the hydrogen sulfide concentration to 50 ppm, or about half of what the control obtained. Sample E reduced the hydrogen sulfide in the 350 ppm sample to about 25 ppm and reduced the concentration in the 180 ppm sample to just above the detection limit at 6 ppm. The results indicate that activated carbon A was the only sample that was capable of reducing the hydrogen sulfide concentration to below the limit of detection at a carbon concentration of 2% and a contact time of 10 minutes.

The results of the experiments show that $H_2S$ is most efficiently removed using an activated carbon that exhibits a pore size that is larger than what would be expected to be effective for a small molecule like hydrogen sulfide. In addition, it appears that a high ash content, e.g., greater than 20%, a high iron (metal) content, or both, also contributes to the carbon's ability to remove hydrogen sulfide from an NGC.

Example 3

Figure 3:
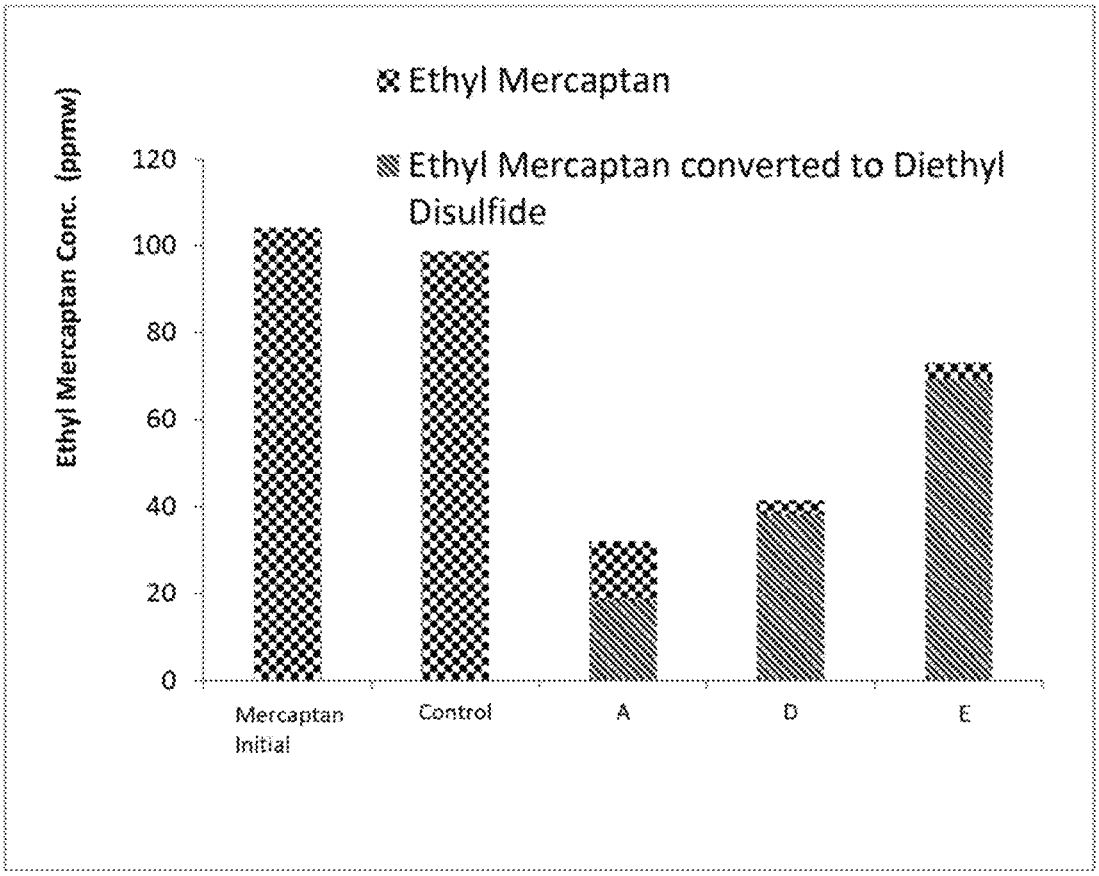
FIG. 3 is a bar graph showing results from an experiment to remove ethyl mercaptan from an NGL.

In a third experiment, carbons A, B, D, and E were evaluated for mercaptan removal from aliphatic hydrocarbons. An ethyl-mercaptan stock solution was made by dissolving 100 μL-ethyl mercaptan in 1.00 L heptane to produce a solution containing 126 μg/g of ethyl-mercaptan. Samples of carbons A, D and E were milled until 95% of the material by mass passed through a size 325 mesh screen. The heptane/mercaptan solution was mixed with each of the carbon samples at room temperature in a sealed flask until equilibrium was reached. A control without activated carbon was similarly treated. Equilibrium was determined by successively analyzing heptane samples for mercaptan content until mercaptan levels were no longer dropping. At this point, the solution was filtered from the carbon and the filtrate was analyzed for ethyl-mercaptan and diethyl disulfide by GCMS. Ethyl-mercaptan can be converted to diethyl disulfide by activated carbon, so these results are important in differentiating between removal of mercaptans and removal of total sulfur. Results are provided below in Table 3. Activated carbon samples D and E were efficient at reducing the concentration of mercaptan in the hydrocarbon solution, but with these activated carbons, much of the mercaptan was converted to disulfide which was not efficiently adsorbed by D and E and therefore remained in the sample. While activated carbon A reduced the mercaptan concentration by less than activated carbons D and E, it was more effective at removing total sulfur from the hydrocarbon solution. FIG. 3 illustrates graphically the amount of mercaptan that is removed or destroyed as well as the amount of ethyl-mercaptan that is converted to diethyl sulfoxide by the different activated carbon samples. FIG. 4 provides a dosage curve showing the residual concentration of ethyl-mercaptan in relation to the amount of activated carbon used. Results indicate greater removal with increasing dose until becoming asymptotic between 2 and 3 wt % of activated carbon in the petroleum liquid.

TABLE 3

Mercaptan Removal

| Carbon ID | Carbon, % by weight | Mercaptan Initial conc., μg/g | Mercaptan Residual conc μg/g | Mercaptan converted to Disulfide μg/g | Mercaptan Removal, % | Carbon Capacity, μg/g | Total S removed, % | Corrected Mercaptan capacity, μg/g |
|---|---|---|---|---|---|---|---|---|
| Control | 0 | 104 | 99 | 0 | 0 | NA | 0 | |
| A | 3.00 | 104 | 14 | 18 | 87 | 3021 | 69 | 2394 |
| A | 0.25 | 126 | 89 | | 29 | 14581 | | |
| A | 0.50 | 117 | 80 | | 32 | 7444 | | |
| A | 1.00 | 117 | 57 | | 51 | 6035 | | |
| A | 2.00 | 122 | 17 | | 86 | 5281 | | |
| A | 3.00 | 100 | 20 | 20 | 80 | 2672 | | |
| A | 0.50 | 122 | 83 | | 32 | 7846 | | |
| B | 0.50 | 122 | 91 | | 25 | 6236 | | |

TABLE 3-continued

| Mercaptan Removal | | | | | | | | |
|---|---|---|---|---|---|---|---|---|
| Carbon ID | Carbon, % by weight | Mercaptan Initial conc., μg/g | Mercaptan Residual conc μg/g | Mercaptan converted to Disulfide μg/g | Mercaptan Removal, % | Carbon Capacity, μg/g | Total S removed, % | Corrected Mercaptan capacity, μg/g |
| B | 2.00 | 115 | 37 | | 68 | 3898 | | |
| D | 3.00 | 103 | 3.5 | 69 | 97 | 3319 | 28 | 951 |
| E | 3.00 | 103 | 3.1 | 38 | 97 | 3333 | 59 | 2024 |

Example 4

In a fourth experiment, the ability of activated carbon A to remove sulfur was evaluated. A stock solution was prepared by dissolving 0.04-0.06 g of elemental sulfur in 100 ml of heptane to produce a 600-800 μg/g solution of elemental sulfur in a hydrocarbon liquid. 50 mL of the prepared elemental sulfur solution was mixed with 1.4 g of activated carbon A (milled to 95% pass through 325 mesh) in a sealed flask. The mixture was stirred for 10 minutes at room temperature. A control without activated carbon was similarly treated. The mixture was filtered through Whatman #1 filter paper and the filtrate was liquid/liquid extracted with toluene and analyzed by GC/MS for elemental sulfur content. The experiment was repeated and results in trial 1 showed a decrease in elemental sulfur from 786 μg/g to 309 μg/g with 4% activated carbon A and, in trial 2, a decrease from 663 μg/g to 247 μg/g. These results indicated a reduction in elemental sulfur of greater than 50% in 10 minutes with activated carbon A.

Example 5

Figure 6:
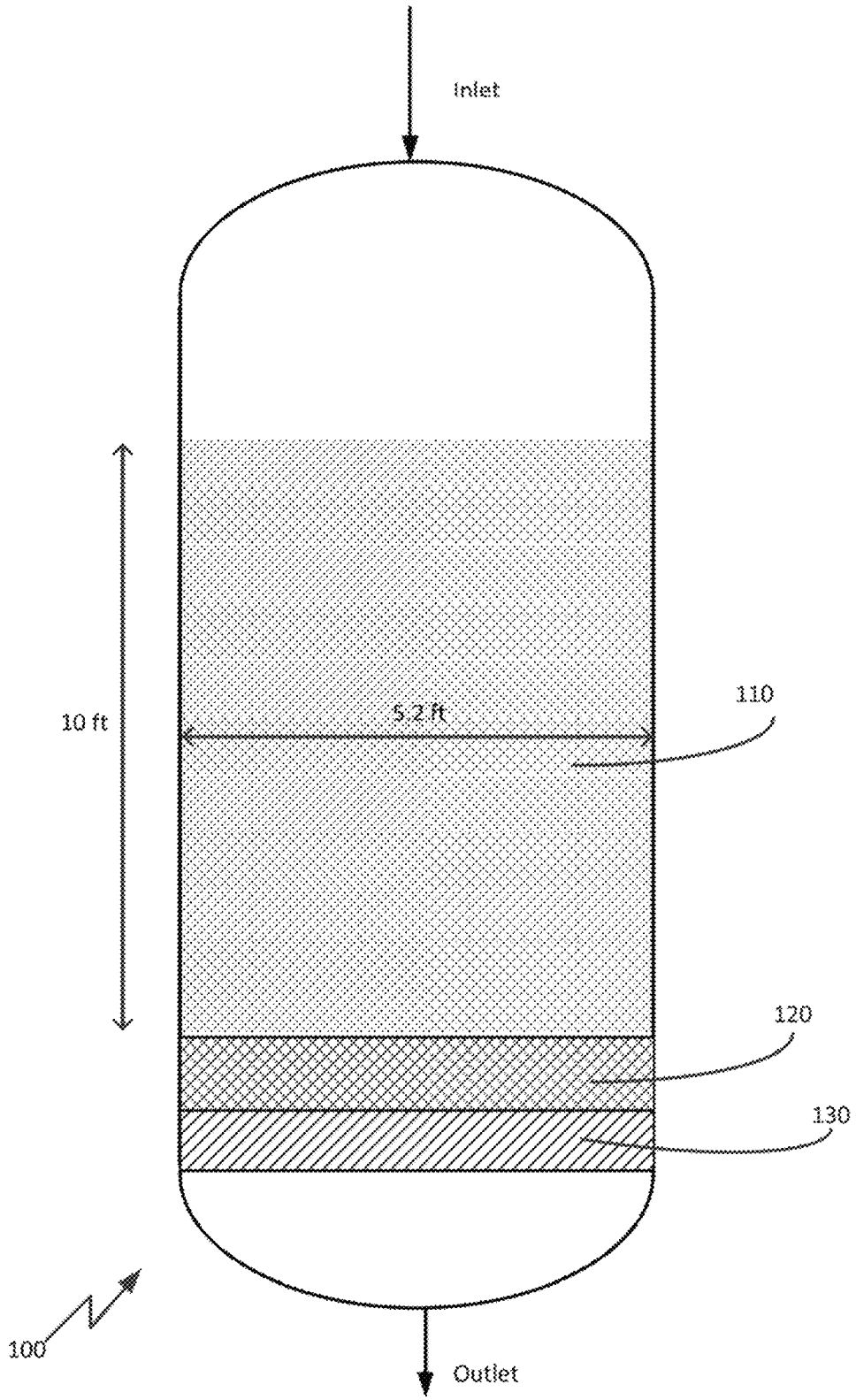
FIG. 6 is a schematic drawing of one embodiment of a system that can be used to remove sulfur from hydrocarbons.

In another set of experiments, tests were run to evaluate the removal of sulfur from NGL in the field. Specifically, a purification system was designed and tested to determine if the activated carbon purified NGLs could meet Y-grade product requirements and specifically the corrosiveness and total sulfur specifications of the Y-grade requirements. Total sulfur for Y-grade certification is determined using ASTM D-2784. To determine corrosiveness for these requirements, the ASTM D-1838 Copper Strip Corrosion Test is used and results need to be <1B to pass. This corrosion test evaluates an NGL by determining its corrosive effects on a copper strip. Polished copper strips are exposed to 200 mL of the NGL at 100° F. for one hour and the resulting color and tone is compared to the chart provided in FIG. 5. The tested purification system used two of the vessels 100, illustrated in FIG. 6, operating in lead/lag mode for reliable remote operation. Samples were collected under pressure (110 PSIG) using a PTFE lined cylinder following the SPOT method. Samples were analyzed using ASTM D-5623 (Sulfur chemiluminescence chromatography) with a Sievers 355 sulfur chemiluminescence chromatograph. At the inlet, the NGL contained 1325 μg/g total sulfur and an initial copper strip test registered 4B on the scale shown in FIG. 5. The NGL was passed from the inlet through the activated carbon bed 110 at a velocity of 1.5 ft/min. The carbon bed was supported by a layer of 0.25 inch glass support balls 120 and a layer of 0.5 inch glass support balls 130. After one pass through the bed of carbon A, the sample was again analyzed using ASTM D-1838, and a result of "1A" was achieved on the copper strip using the chart of FIG. 5. Thus, the treatment system was capable of producing an NGL that meets the Y-grade requirements from an initial material that contained 1325 μg/g sulfur and registered 4B under the ASTM D-1838 test. In other embodiments, the corrosiveness can be reduced by more than 2 levels, more than 3 levels or more than 4 levels on the chart. For example, a 4A or higher sample can be reduced to below 3a, below 2d, below 2b or below 2a.

Example 6

In another set of experiments, the purification system of Example 5 was used to treat an NGL contaminated with multiple sulfur containing compounds, and the drop in concentration of specific sulfur containing compounds was measured. Samples were analyzed using SCD chromatography, as above. Analytical results from samples taken at the inlet (pre-treatment) and the outlet (post-treatment) are provided. Results including "<" are below the limit of detection of the analytical technique. Results are provided in parts per million on both a weight/volume (mg/L) basis and a weight/weight (μg/g) basis. Except for carbon disulfide, the concentration of all sulfur containing compounds was reduced by the activity of activated carbon A. Carbon disulfide increased in concentration, it is believed, due to the conversion of ethyl mercaptan to carbon disulfide.

TABLE 4

| Sulfur Compound Removal from NGL | | | | |
|---|---|---|---|---|
| | Inlet Concentration | | Outlet Concentration | |
| | mg/L | μg/g | mg/L | μg/g |
| LIGHT END COMPONENTS | | | | |
| CARBONYL SULFIDE (COS) | 0.660 | 0.610 | 0.449 | 0.418 |
| HYDROGEN SULFIDE ($H_2S$) | 0.192 | 0.101 | 0.030 | 0.016 |
| CARBON DISULFIDE ($CS_2$) | 0.176 | 0.206 | 0.769 | 0.907 |
| DIMETHYL SULFIDE $(CH_3)_2S$ | 0.639 | 0.610 | 0.381 | 0.367 |
| DIMETHYL DISULFIDE $(CH_3)_2S_2$ | 1.518 | 2.198 | 0.997 | 1.455 |
| DIETHYL DISULFIDE $(C_2H_5)_2S_2$ | <0.010 | <0.027 | <0.010 | <0.027 |

TABLE 4-continued

| Sulfur Compound Removal from NGL | Inlet Concentration | | Outlet Concentration | |
|---|---|---|---|---|
| | mg/L | μg/g | mg/L | μg/g |
| SULFUR DIOXIDE ($SO_2$) | <0.010 | <0.009 | <0.010 | <0.009 |
| TOTAL LIGHT END COMPONENTS, mg/L | 3.185 | 3.725 | 2.626 | 3.163 |
| METHYL MERCAPTAN | 5.426 | 4.013 | 2.879 | 2.146 |
| ETHYL MERCAPTAN | 2.717 | 2.595 | 1.705 | 1.642 |
| iso-PROPYL MERCAPTAN. | 0.930 | 1.089 | 0.482 | 0.569 |
| normal-PROPYL MERCAPTAN | 1.562 | 1.829 | 1.031 | 1.217 |
| ETHYL METHYL SULFIDE | 0.140 | 0.164 | 0.270 | 0.319 |
| iso-BUTYL MERCAPTAN | 0.221 | 0.306 | 0.096 | 0.134 |
| normal-BUTYL MERCAPTAN | 0.169 | 0.234 | 0.113 | 0.158 |
| DIETHYL SULFIDE | <0.010 | <0.020 | <0.010 | <0.020 |
| sec-BUTYL MERCAPTAN | <0.010 | <0.020 | <0.010 | <0.020 |
| tert-BUTYL MERCAPTAN | 0.207 | 0.204 | 0.142 | 0.141 |
| PENTYL AND HEAVIER MERCAPTANS | <0.010 | <0.023 | <0.010 | <0.023 |
| 2-METHYLTHIOPHENE | <0.010 | <0.021 | <0.010 | <0.021 |
| 3-METHYLTHIOPHENE | <0.010 | <0.021 | <0.010 | <0.021 |
| THIOPHENE | 0.174 | 0.225 | 0.179 | 0.233 |
| ETHYL PROPYL SULFIDE | <0.010 | <0.023 | <0.010 | <0.023 |
| ETHYL METHYL DISULFIDE | <0.010 | <0.024 | <0.010 | <0.024 |
| BENZOTHIOPHENE | 1.165 | 2.403 | 0.425 | 0.884 |
| METHYL BENZOTHIOPHENES AND HEAVIER | <0.010 | <0.032 | <0.010 | <0.032 |
| TOTAL MERCAPTANS AND THIOPHENES | | 13.063 | | 7.443 |
| TOTAL ALL SULFURS | | 16.788 | | 10.607 |

Example 7

In another experiment, activated carbons A and D were tested for their ability to remove carbon disulfide ($CS_2$) from a naphtha sample. Sulfur standards for gasoline are consistently being reduced, and gasoline may be limited to total sulfur levels of, for example, 80 or 30 ppm. Therefore, techniques that can reduce the total sulfur concentration in gasoline and gasoline components, and fuels in general, may be of particular use. One particular problem is the concentration of carbon disulfide in the naphtha component of gasoline. In some cases, naphtha cannot exceed 100 ppm total sulfur when blended to make gasoline, so an effective way to reduce total sulfur to below this level would be industrially useful.

Tests were run using a naphtha sample that contained 95 ppm total sulfur as 93 ppm $CS_2$ and 2 ppm dimethyl sulfide (DMS), by weight. Varying sample sizes of activated carbon A (milled to 95% mass pass through 325 mesh sieve) and activated carbon D (milled to 95% mass pass through 325 mesh sieve) were mixed with 100 g of the contaminated naphtha sample as provided in Table 4 to determine the adsorption efficiency of each. The tests were conducted at standard temperature and pressure and were mixed for the times indicated. The naphtha was filtered through Whatman #40 filter paper and the filtrate was analyzed for total sulfur. Results are provided in Table 6 and indicate that with an equivalent concentration of carbon and equivalent mixing time, carbon A removes almost twice as much $CS_2$ as does carbon D. The results also show that increasing concentrations of activated carbon provide more complete removal of $CS_2$ up to and including 3% by weight. It is believed that higher concentrations such as 4 or 5% by weight would marginally improve the removal efficiency. The results also indicate that an activated carbon produced from lignite can provide improved removal over one made from bituminous coal. Results may also be improved when the activated carbon has a total ash content of greater than 15%, a mesoporosity of greater than 0.13 $cm^3/g$, a microporosity of less than 0.39 $cm^3/g$, a macroporosity of greater than 0.27 $cm^3/g$, and/or an iodine number of less than 920 mg/g. The results also indicate that activated carbons having ash contents of greater than 15%, greater than 20% or greater than 25% may be of particular use in removing sulfur from hydrocarbon based fuels such as gasoline.

TABLE 4

| Sulfur Compound Removal from NGL | | | | | |
|---|---|---|---|---|---|
| Activated Carbon | Carbon Dose Wt % | Contact Time min | Total Sulfur Pre-treatment ppm | Total Sulfur Post-Treatment ppm | Total Sulfur Removal Wt % |
| A | 2 | 15 | 95 | 51 | 46.3 |
| A | 1 | 30 | 95 | 64 | 32.6 |
| A | 2 | 30 | 95 | 43 | 54.7 |
| A | 3 | 30 | 95 | 31 | 67.4 |
| D | 2 | 30 | 95 | 68 | 28.4 |

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

The invention claimed is:

1. A method of removing sulfur compounds from petroleum liquid, the method comprising:

contacting a petroleum liquid with activated carbon, the petroleum liquid comprising at least one sulfur containing compound, the activated carbon having an ash content of greater than 20% by weight and a metal content of greater than 2,000 ppm by weight; and removing greater than 90% of the sulfur compounds originally in the petroleum liquid to provide a reduced sulfur petroleum liquid.

2. The method of claim 1 wherein the petroleum liquid, prior to contacting, comprises greater than 1% sulfur by weight.

3. The method of claim 1 wherein the petroleum liquid comprises hydrogen sulfide of which at least 90% by weight is removed by contacting with the activated carbon.

4. The method of claim 1 wherein contacting comprises flowing the petroleum liquid through one or more beds of the activated carbon.

5. The method of claim 1 wherein the petroleum liquid comprises mercaptans of which at least 90% by weight are removed from the liquid by contacting the liquid with the activated carbon.

6. The method of claim 1 wherein the total sulfur concentration is reduced to less than 10 μg/g.

7. A method comprising:

determining the concentration of sulfur or a sulfur containing compound in a petroleum liquid stream;

identifying the stream as requiring removal of sulfur or a sulfur containing compound;

contacting the petroleum liquid with an activated carbon, the activated carbon having an ash content of greater than 20% and a metal content of greater than 2,000 ppm; and reducing the sulfur content of the petroleum liquid to less than 10 ppm total sulfur or less than 10 ppm of the sulfur containing compound.

8. The method of claim 7 wherein the petroleum liquid is flowed through a bed of the activated carbon.

9. The method of claim 7 wherein the concentration of sulfur in the petroleum liquid is reduced by greater than 90% by weight.

10. The method of claim 7 further comprising selling, transporting or burning the petroleum liquid as a non-sulfur natural gas condensate.

11. The method of claim 7 comprising analyzing the petroleum liquid for reduced sulfur content using an optical technique selected from colorimetry, turbidimetry and transmission/absorbance.

12. The method of claim 7 comprising re-flowing the petroleum liquid through the activated carbon.

13. The method of claim 7 wherein the activated carbon comprises native metals that are uniformly distributed throughout the activated carbon.

14. The method of claim 7 wherein the activated carbon contains greater than 1,000 ppm iron, greater than 1,000 ppm aluminum, greater than 1,000 ppm titanium and/or greater than 1,000 ppm tungsten.

15. The method of claim 7 wherein the activated carbon contains less than 5,000 ppm halogens, by weight.

16. A method of reducing the corrosivity of a natural gas liquid, the method comprising:

providing a natural gas liquid exhibiting an ASTM D-1838 Copper Strip Corrosion Test rating of higher than 2e;

contacting the natural gas liquid with an activated carbon to reduce the ASTM D-1838 rating to 1B or lower and the total sulfur concentration to less than 150 μg/g.

17. The method of claim 16 wherein the activated carbon has a total ash content of greater than 20% by weight.

18. The method of claim 16 wherein contacting includes passing the natural gas liquid through a bed of the activated carbon.

19. The method of claim 16 wherein after contacting the natural gas liquid with the activated carbon the natural gas liquid meets Y-grade product specifications.

* * * * *